US005166966A

United States Patent [19]

Steinmeyer

[11] Patent Number: 5,166,966

[45] Date of Patent: Nov. 24, 1992

[54] COATED X-RAY FILTERS

[75] Inventor: Peter A. Steinmeyer, Farmington, N. Mex.

[73] Assignee: The United States of America as represented by the United States Department of Energy, Washington, D.C.

[21] Appl. No.: 476,186

[22] Filed: Feb. 7, 1990

[51] Int. Cl.[5] ..... G21K 3/00

[52] U.S. Cl. ..... 378/156; 378/158

[58] Field of Search ..... 378/156, 158, 161, 44; 250/505.1

[56] References Cited

U.S. PATENT DOCUMENTS 2,541,599 2/1951 Morrison .
3,779,721 12/1973 Herman ..... 29/199
3,945,555 3/1976 Schmidt ..... 228/126
4,431,709 2/1984 Bronnes et al. ..... 378/161
4,499,591 2/1985 Hartwell ..... 378/62
4,764,946 8/1988 Teleki ..... 378/156
4,945,552 7/1990 Ueda et al. ..... 378/156

*Primary Examiner*—Constantine Hannaher
*Assistant Examiner*—Don Wong
*Attorney, Agent, or Firm*—Anne D. Daniel; James H. Chafin; William R. Moser

[57] ABSTRACT

A radiation filter for filtering radiation beams of wavelengths within a preselected range of wavelengths comprises a radiation transmissive substrate and an attenuating layer deposited on the substrate. The attenuating layer may be deposited by a sputtering process or a vacuum process. Beryllium may be used as the radiation transmissive substrate. In addition, a second radiation filter comprises an attenuating layer interposed between a pair of radiation transmissive layers.

8 Claims, 1 Drawing Sheet

COATED X-RAY FILTERS

The present invention relates to an X-ray filter and a method of manufacturing the same. The Government has rights in this invention pursuant to Contract No. DE-AC04-76DP03533 awarded by the U.S. Department of Energy and Rockwell International Corporation.

BACKGROUND OF THE INVENTION

In many applications, it is desirable to employ an X-ray beam that is restricted in its wavelength range. Filters that are used to restrict the wavelength range are particularly important for diffraction and fluoresence applications.

The use of heavy metal filters for producing a relatively monochromatic beam from a source is well known. Several types of source/filter combinations have been developed. For instance, the use of a zirconium filter with a molybdenum source removes most of the continuous radiation from the source and produces a relatively pure K $\alpha$ line which can be useful for analytical purposes. Monochromatic radiation produced in this way is widely used in X-ray diffraction studies because the resulting diffraction line spectra are not complicated by extraneous lines arising from K beta radiation.

Filtration of the continuous radiation from a source has been performed using thin strips of metal. Problems exist in using thin metal strips as filtering elements in that they are not mechanically strong and are usually required to be placed and connected to a backing or support. Very thin filter elements cannot be achieved by this method of fabrication. Such a filter is disclosed in U.S. Pat. No. 4,499,591.

Typical filters for monochromatization of radiation beams are fabricated by rolling techniques. However, some materials are difficult to roll to the required thicknesses (typically from 12 to 25 microns), requiring further fabrication methods. Also, achieving a uniform thickness is difficult using rolling techniques. Thus, there is a need for an improved method of manufacture.

The oxidation of some filter materials may present a problem with filter quality. A need exists for a composite filter which protects oxidizable filter materials necessary for certain applications.

SUMMARY OF THE INVENTION

It is a further object of the present invention to provide a thin, composite radiation beam filter comprising a filter material coated on a substrate.

It is yet a further object of the present invention to provide a composite radiation beam filter which is uniform in thickness, free of pinholes, and which is mechanically stable.

The present invention relates to a filter for radiation beams, such as X-rays, which filter comprises a substrate of a transmissive material which selectively allows transmission of radiation beams and an attenuating layer which suppresses the transmission of undesired wavelengths. The attenuating layer is coated onto the substrate as a thin filter of high mechanical integrity. The filter is virtually free of pinholes and interfacial voids between the substrate and the attenuating layer material.

The present invention also relates to a method of manufacturing the radiation beam filter of the invention.

The invention may be more fully understood with reference to the accompanying drawings and the following description of the embodiments shown in those drawings. The invention is not limited to the exemplary embodiments but should be recognized as contemplating all modifications within the skill of an ordinary artisan.

DESCRIPTION OF THE INVENTION

Figure 1:
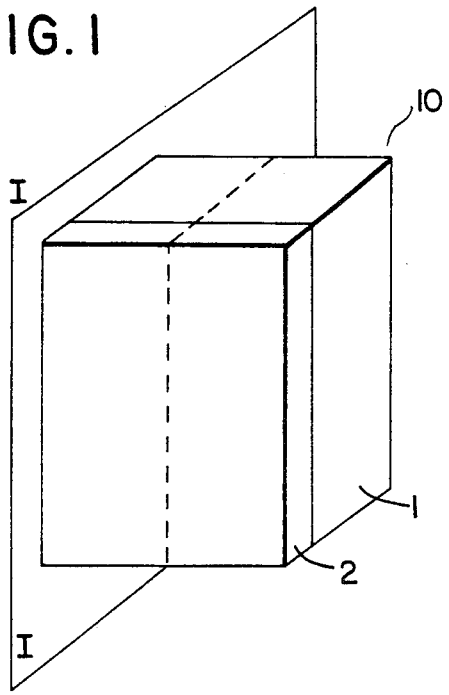
FIG. 1 is a perspective view of a radiation beam filter according to the present invention.
Figure 2:
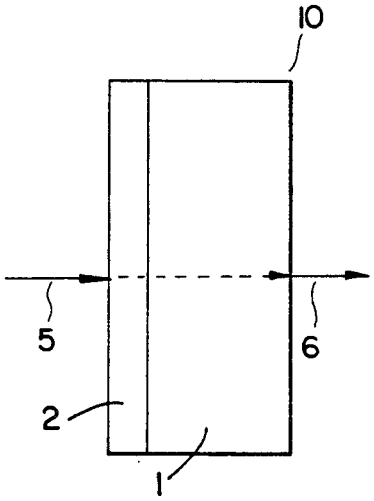
FIG. 2 is a sectional view of the filter of FIG. 1 taken along plane I also showing the passage of the beam through the composite filter.

Referring to the drawings, FIGS. 1 and 2 show a filter 10 of the present invention. The filter 10 is used to attenuate undesired wavelengths (specifically, K beta radiation) emitted from a radiation source such as an X-ray generator. The filter 10 is of a composite construction and comprises a substrate 1 and an attenuating layer 2.

FIG. 2 also shows the passage of an X-ray beam through the composite filter 10. In FIG. 2, an incident X-ray beam 5 impinges on the composite filter 10 at the attenuating layer 2, passes through the filter 10, and emerges as a transmitted, filtered X-ray beam 6 from the side of filter 10 opposite its entrance.

In the composite structure of filter 10, the substrate 1 is relatively transmissive to radiation. Preferably, the substrate 1 comprises beryllium. Such a substrate typically causes a slight loss in X-ray intensity, e.g. a copper K alpha line is attenuated less than 2% in passing through a 75 micron thick beryllium substrate. The preferred composition of the attenuating layer 2 may vary depending upon the wavelengths which are to be filtered. The attenuating layer 2 is preferably of a material of atomic number one or two lower than that of the X-ray target.

The thicknesses of the attenuating layer 2 and of the substrate 1 are generally not restricted. The thickness of the substrate 1 is preferably between 50 and 100 microns, or of a thickness to provide mechanical strength and rigidity in a particular application (e.g. size, target material).

Material for the attenuating layer may comprise a heavy metal such as nickel, silver, gold or zirconium. Other materials may also be used. The material should be selected to appropriately match the target (radiation source). For example, when using copper radiation, an attenuating layer of nickel is preferred. When using molybdenum radiation, a zirconium attenuating layer is preferred.

The attenuating layer 2 may be coated on the substrate by a sputtering deposition or vacuum deposition technique. Other coating and deposition techniques may be employed to produce a composite filter virtually free of pinholes and free of interfacial voids between the substrate 1 and the attenuating layer 2, which is a rugged integral structure of uniform thickness. Plasma deposition, electrodeposition, electro-less deposition, chemical vapor deposition and ion deposition techniques may also be employed. Attenuating layer thicknesses of only a few microns are readily achievable. Composite filter thicknesses of under 100 microns are also easily achievable.

Figure 3:
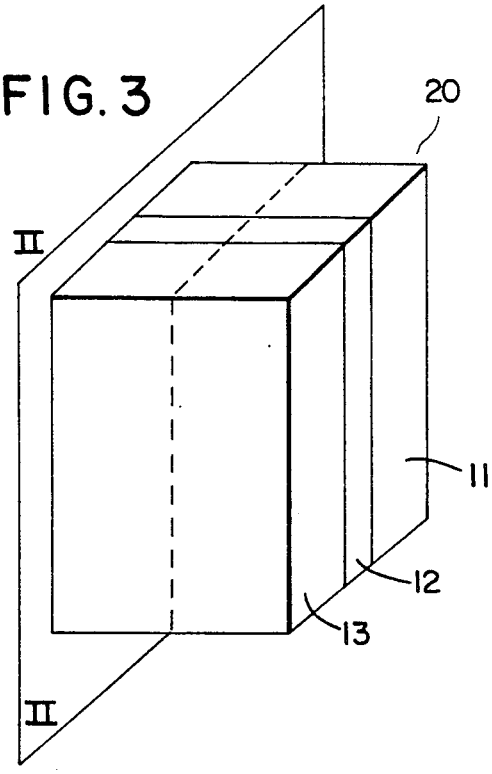
FIG. 3 is a perspective view of a composite radiation beam filter in accordance with the present invention.
Figure 4:
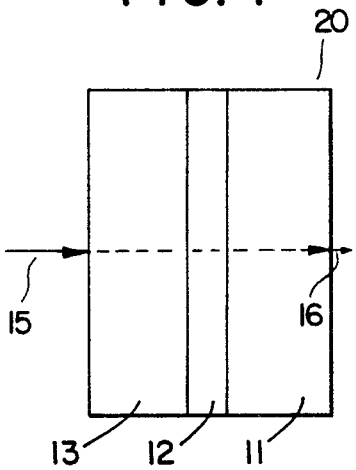
FIG. 4 is a sectional view of the filter of FIG. 3 taken along plane II also showing the passage of the beam through the composite filter.

FIGS. 3 and 4 show a second embodiment according to the present invention, in which a composite filter 20 comprises an attenuating layer 12 interposed between a radiation transmissive substrate 11 and a radiation transmissive protective layer 13.

FIG. 4 also shows the passage of an X-ray beam through the composite filter 20. In FIG. 4, the incident X-ray beam 15 is shown impinging on the composite filter 20 at the protective layer 13, passing through the composite filter 20, and emerging as a transmitted, filtered X-ray beam 16 from the side of filter 20 opposite its entrance.

In the composite structure of filter 20, the substrate 11 and the protective layer 13 may be of the same or differing thicknesses and are preferably formed of beryllium. The radiation transmissive layers 11 and 13 support the attenuating layer 12 and they protect the attenuating layer 12 from oxidation (particularly where the attenuating layer 12 is formed of an oxidizable or otherwise unstable material).

The second embodiment is preferably manufactured by laminating an attenuating layer on a substrate and then laminating a protective layer on the attenuating layer. The substrate and attenuating layer are preferably manufactured as described above for the first embodiment. The protective layer is formed of radiation transmissive material which can be the same as or different from that of the substrate. Any of the deposition techniques described above in connection with the first embodiment may be employed for the laminating operations of the second embodiment.

In general, the substrate and the protective layer may each be thinner than the substrate of the first embodiment without loss of structural integrity due to the added support provided by the protective layer.

In another preferred method of manufacturing the radiation filters of either the first embodiment or the second embodiment, the substrate is formed by depositing a layer of radiation transmissive material onto a mold or surface from which the layer may be removed. Additional layers (the attenuating layer or both the attenuating layer and the protective layer) may be applied to the substrate while still in the mold, or, such layers can be formed individually or together in the mold. Release agents may be employed to facilitate removal from the mold or surface.

Either of the first and second embodiments can be formulated and manufactured so that the attenuating layer allows passage of substantially only a monochromatic beam of radiation, thus providing filters for monochromatization of X-rays.

EXAMPLE

An X-ray filter for use with a copper X-ray target was fabricated as follows:

An attenuating layer comprising nickel was vacuum deposited on a 75 micron thick beryllium substrate to form an attenuating layer of a thickness of 14 microns. The composite thus formed was of uniform thickness, was free of pinholes, and was more durable than a foil filter.

It is to be understood that the present invention is not limited to the specific embodiments shown and described herein. It will be appreciated by those skilled in the art that additions, modifications, substitutions and deletions may be made without departing from the scope of the invention defined in the appended claims.

What is claimed is:

1. An X-radiation filter for use with an X-ray target, comprising:

(a) a substrate formed of beryllium; and (b) a selectively attenuating layer for attenuating radiation beams of undesired wavelength within a preselected range of wavelengths, said attenuating layer comprising a filter material made from an element of an atomic number one or two lower than that of the X-ray target, said element being selected for transmitting a high ration of K alpha to K beta radiation for the selected X-ray target, where said substrate is coated with said attenuating layer to form a composite filter structure virtually free of filter pinholes and capable of selective filtration of radiation.

2. An X-radiation filter as in claim 1, wherein said attenuating layer comprises nickel and said radiation beams are from a copper radiation target.

3. A method of manufacturing an X-radiation filter for use with an X-ray target, comprising depositing a layer of radiation transmissive material made of beryllium onto a surface from which said radiation transmissive layer can be removed to form a radiation transmissive substrate and coating a radiation attenuating layer, comprising a filter material made from an element having atomic number one or two lower than that of the X-ray target, said element being selected for transmitting a high ratio of K alpha to K beta radiation for the selected X-ray target, onto said radiation transmissive substrate to form a composite structure virtually free of filter pinholes.

4. A method of manufacturing an X-radiation filter as in claim 3, wherein said substrate is formed by vacuum deposition.

5. A method of manufacturing an X-radiation filter as in claim 3, further comprising coating a protective layer of radiation transmissive material onto said attenuating layer.

6. A method of manufacturing an X-radiation filter as in claim 5, further comprising applying said attenuating layer to said substrate and said protective layer to said attenuating layer while said substrate is still on said surface.

7. A method of manufacturing an X-radiation filter as in claim 3, further comprising applying said attenuating layer to said substrate while said substrate is still on said surface.

8. A method of manufacturing an X-radiation filter as in claims 3 wherein said surface is a mold.

* * * * *